US005807119A

United States Patent [19]

Baechtle et al.

[11] Patent Number: 5,807,119

[45] **Date of Patent: *Sep. 15, 1998**

[54] MECHANICAL COUPLING DEVICE

[76] Inventors: David Robert Baechtle, 14 Cold Spring Rd., Dillsburg, Pa. 17019; Raymond Robert Buchheister, 74 Wenchoff Rd., Fairfield, Pa. 17320; Robert Everett Lorren Marcus, 248 Sue Dr., Hummelstown, Pa. 17036; Nathan John Norris, 2701 W. Royal La. No. 805, Irving, Tex. 75063

[ * ] Notice: This patent issued on a continued prosecution application filed under 37 CFR 1.53(d), and is subject to the twenty year patent term provisions of 35 U.S.C. 154(a)(2).

[21] Appl. No.: 744,845

[22] Filed: Nov. 8, 1996

[51] Int. Cl.[6] ..... H01R 9/09

[52] U.S. Cl. ..... 439/79; 439/540.1

[58] Field of Search ..... 439/79, 540.1, 439/80

[56] References Cited

U.S. PATENT DOCUMENTS

| | | | |
|---|---|---|---|
| 4,050,769 | 9/1977 | Ammon | 339/196 M |
| 4,343,528 | 8/1982 | Lucius et al. | 339/198 |
| 4,428,640 | 1/1984 | Pittman | 439/696 |
| 4,591,228 | 5/1986 | Vasseur | 339/198 H |
| 4,591,949 | 5/1986 | Lahr | 361/394 |
| 4,709,976 | 12/1987 | Nakama et al. | 439/350 |
| 4,790,763 | 12/1988 | Weber et al. | 439/65 |
| 4,857,017 | 8/1989 | Erk | 439/695 |
| 4,976,628 | 12/1990 | Fedder | 439/101 |
| 5,198,279 | 3/1993 | Beinhaur et al. | 439/79 |
| 5,207,601 | 5/1993 | Vasseur et al. | 439/715 |
| 5,312,276 | 5/1994 | Hnatuck et al. | 439/681 |
| 5,501,613 | 3/1996 | Lenoir | 439/79 |
| 5,605,476 | 2/1997 | McNamara et al. | 439/540.1 |
| 5,639,250 | 6/1997 | Neef et al. | 439/79 |

FOREIGN PATENT DOCUMENTS

| | | |
|---|---|---|
| 0170455A | 2/1986 | European Pat. Off. . |
| 0696091A | 2/1996 | European Pat. Off. . |
| WO92/22943 | 12/1992 | WIPO . |

*Primary Examiner*—Gary F. Paumen
*Attorney, Agent, or Firm*—Katherine A. Nelson

[57] ABSTRACT

A device (20) for coupling first and second electrical connectors (40,70) comprises a dielectric member having a plurality of openings (32) extending therethrough, a first portion (34) of the openings (32) being adapted to grip corresponding exposed body portions (68) of terminals (60) secured in a first connector (40), and a second portion (36) of the openings (32) being adapted to grip corresponding exposed body portions (98) of terminals (90) secured in a second connector (70). Upon placing the first and second connectors (40, 70) adjacent each other and positioning the openings (32) in gripping relationship with respective body portions (68, 98) of the terminals (60,90) of the first and second connectors (40,60), the device (20) mechanically secures together the first and second connectors (40, 70) adjacent each other.

20 Claims, 9 Drawing Sheets

MECHANICAL COUPLING DEVICE

This application claims the benefit of U.S. Provisional Application(s) No(s). 60/006,506, Filed Nov. 9, 1995 and 60/010,806, Filed on Jan. 30, 1996.

FIELD OF THE INVENTION

The present invention is directed to electrical connectors and more particularly to devices for mechanically joining adjacent modular connectors.

BACKGROUND OF THE INVENTION

Today's electronic technology often requires the use of high density connectors of relatively long lengths to handle the number of circuits required for the equipment. Long length connectors, for example, 10 inches or longer, are more difficult to mold than are shorter connectors. It is desirable, therefore, to have a cost effective way to interconnect a plurality of connectors to achieve the desired number of circuit positions while maintaining the desired grid array spacing of contacts in the housing.

U.S. Pat. No. 4,790,763 shows one way of interconnecting modular connectors in which the sides of the housings have slots and latches to secure the connectors together. Typically the additional housing material required for the interlocking structure takes up extra space on the board thereby interrupting the desired grid array of contacts. It is desirable, therefore, to have a device to secure together connector housings without needing to design specific latches or to modify the housings in some manner.

SUMMARY OF THE INVENTION

The present invention is directed to a device for coupling first and second electrical connectors. Each connector includes a housing having a plurality of terminals secured therein such that a portion of a body section of at least one of the terminals is exposed from the housing. The coupling device is a dielectric member having a plurality of openings extending therethrough. At least a first opening in the device is adapted to grip an exposed body portion of at least one terminal of the first connector and at least a second opening in the device is adapted to grip a body portion of at least one terminal of the second connector. Upon placing the first and second connectors adjacent each other and positioning the device with the openings in a gripping relationship with the respective terminal body portions of the first and second connectors, the device mechanically secures together the first and second connectors adjacent each other.

In one preferred embodiment of the coupling device, the dielectric member includes an array of apertures extending therethrough, the apertures being arranged in rows and columns and having the same grid spacing as the arrays of terminals within the respective connector housings. The array includes a plurality of apertures adapted to grip body portions of a corresponding plurality of terminals within the first housing, and a second portion of apertures adapted to grip exposed body portions of the terminals in the second housing. The apertured device is suitable for use with terminals, each having an exposed contact portion at the leading end thereof that is smaller in width than the respective body portion of the terminal, thus the contact portions are dimensioned to pass through corresponding apertures of the device, until the apertures of the device grip the body portions of the terminals in an interference fit, and the contact sections of the respective terminals extend outwardly below the coupling device. The coupling device preferably is molded from thermoplastics or other suitable materials that can withstand soldering temperatures, as known in the art.

In a second embodiment the coupling device includes a plurality of slots adapted to be mounted to the connector terminals at right angles thereto such that they extend between adjacent terminals. In this embodiment of the present invention, the coupling device links the two connectors together and maintains spacing of the grid array of the contacts while allowing the housings to be molded in shorter units. The coupling device also permits joining together of different size connectors thus facilitating customized sizing without requiring additional molds for each of the different sizes.

In a third embodiment the coupling device includes two parts, the first being a clip for interlocking adjacent housing walls together and the second being a plate-like dielectric member having a plurality of openings extending therethrough adapted to be received by a first plurality of terminals in a first connector and a second plurality of terminals in a second connector. Alternative embodiments of the clip are also disclosed.

Embodiments will now be described by way of example with reference to the accompanying drawings.

DETAILED DESCRIPTION OF THE INVENTION

Figure 1:
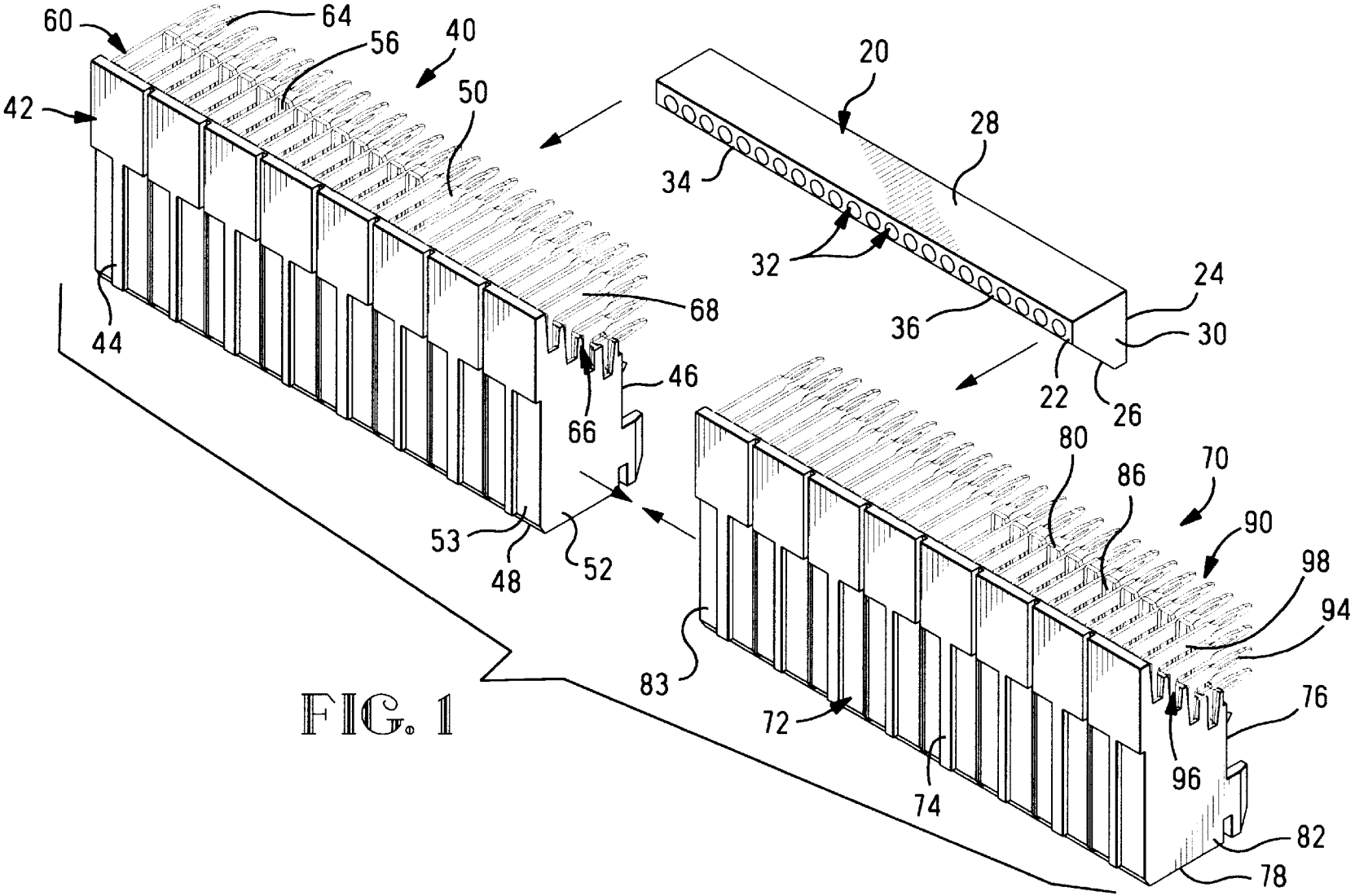
FIG. 1 is an isometric view of the connector assembly of the present invention with the connectors and coupling device exploded from one another.
Figure 2:
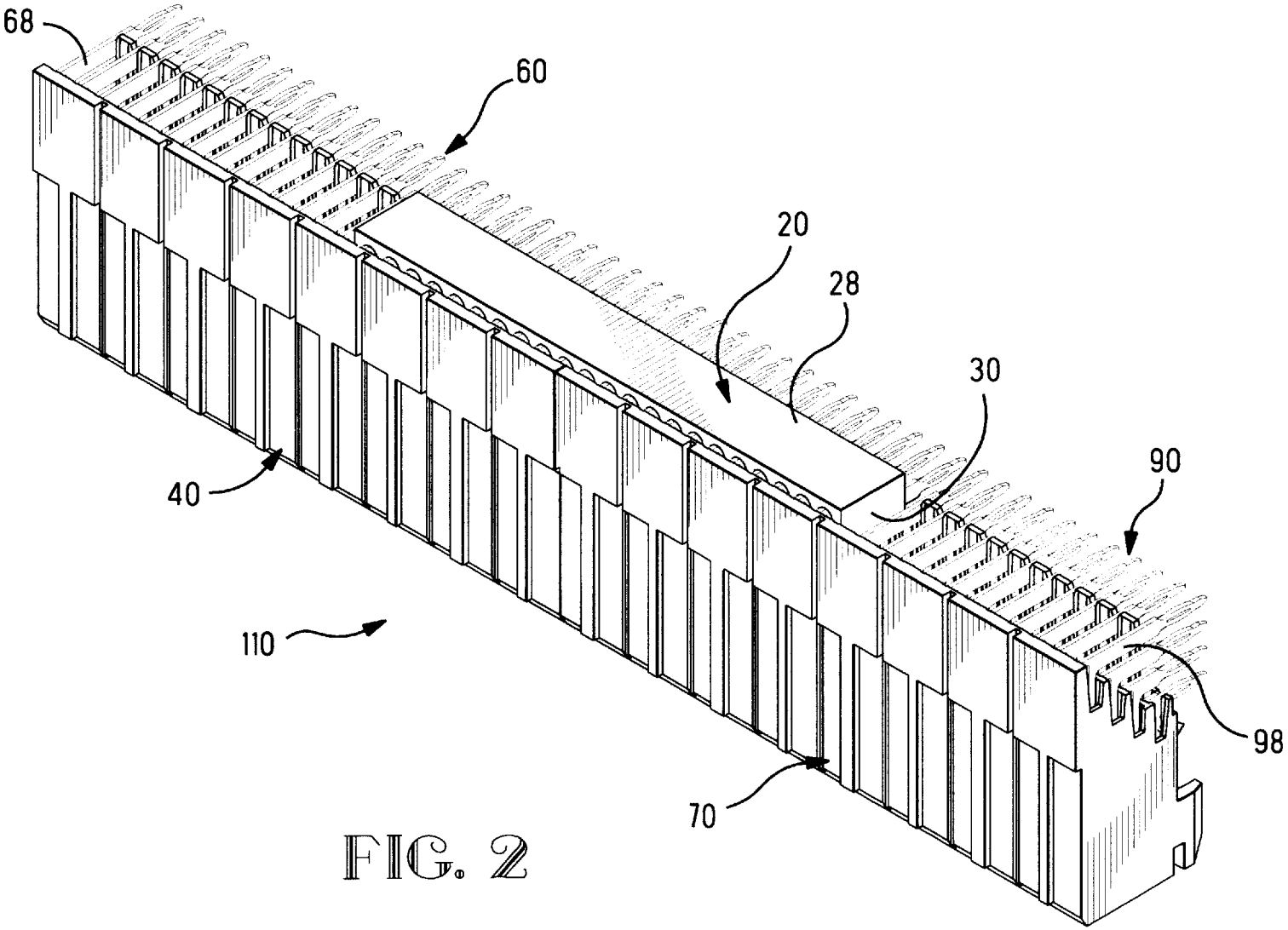
FIG. 2 is an isometric view of the assembled coupled connector assembly.
Figure 6:
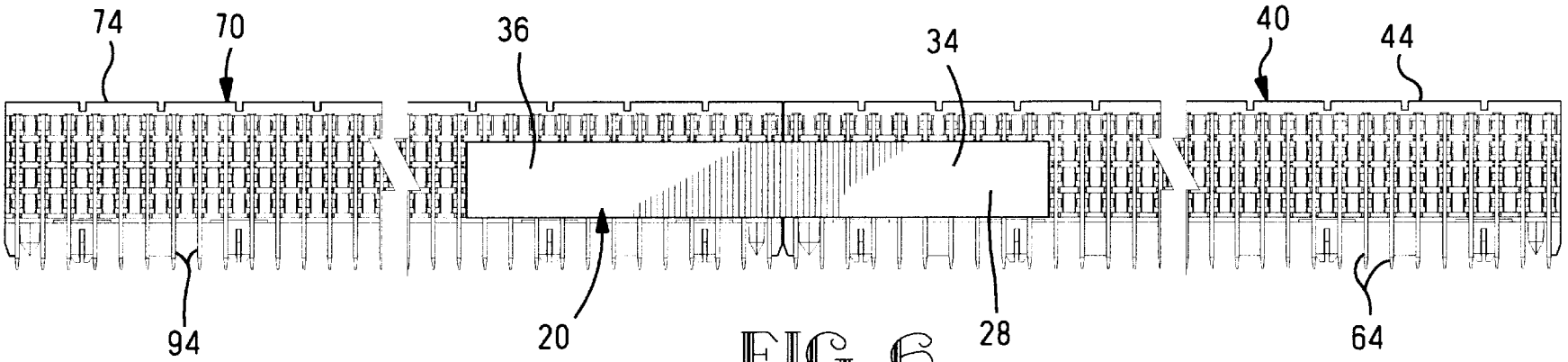
FIG. 6 is a back plan view of the connector assembly of FIG. 2.
Figure 4:
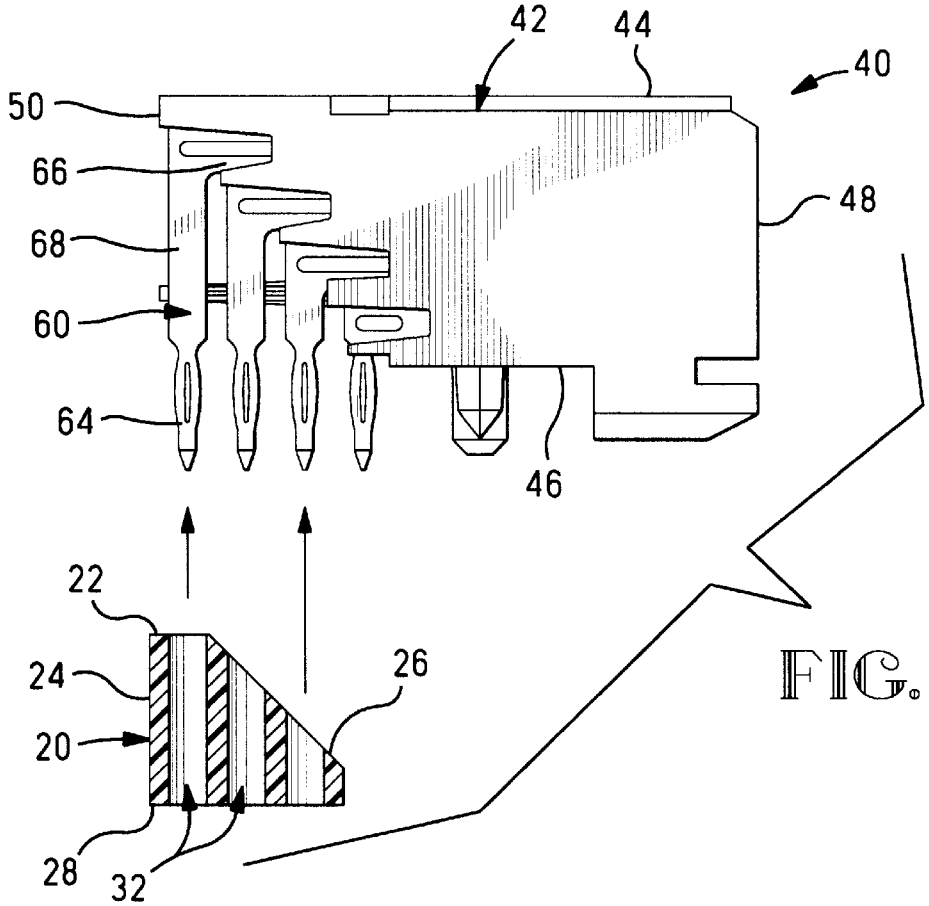
FIG. 4 is an end view of one of the connectors with the coupling device shown in cross-section and in alignment for positioning on the terminals.

For purposes of illustrating the invention, coupling device 20 is illustrated, being used with first and second right angle connectors 40, 70 as best seen in FIGS. 1, 2, and 6. First and second connectors 40, 70 include respective first and second end portions 53, 83 to be adjacent each other when the connectors are coupled. It is to be understood that the invention is not limited to the use of right angle connectors nor to the geometric configuration of the device shown herein.

First connector 40 includes a housing 42 having a top wall 44, a mounting face or bottom wall 46, a mating face 48, an assembly or rear face 50, and endwalls 52. Housing 42 further includes a plurality of terminal receiving passageways 56 having first terminals 60 disposed therein. Each first terminal 60 includes a first contact portion (not shown) exposed at the mating face 48 for mating with a complementary connector (not shown), a second contact portion 64 extending outwardly from the housing 42 at the mounting face 46 thereof, and intermediate body section 66 extending therebetween. A portion 68 of the body section 66 is exposed along the assembly or rear face 50 of the connector housing 42.

The second connector 70 includes a housing 72 having a top wall 74, a mounting face or bottom wall 76, mating face 78, an assembly or rear face 80, and endwalls 82. Housing 72 includes a plurality of terminal receiving passageways 86 extending from the mounting face 76 to the mating face 78, each passageway 86 having a second terminal 90 therein. Each second terminal 90 has a first contact portion (not shown) exposed at the mating face 78 for mating with a complementary connector (not shown), a second contact portion 94 extending outwardly from the housing 72, and an intermediate body section 96 extending therebetween. Body section 96 includes a body portion 98 exposed at the assembly or rear face 80 thereof.

Figure 3:
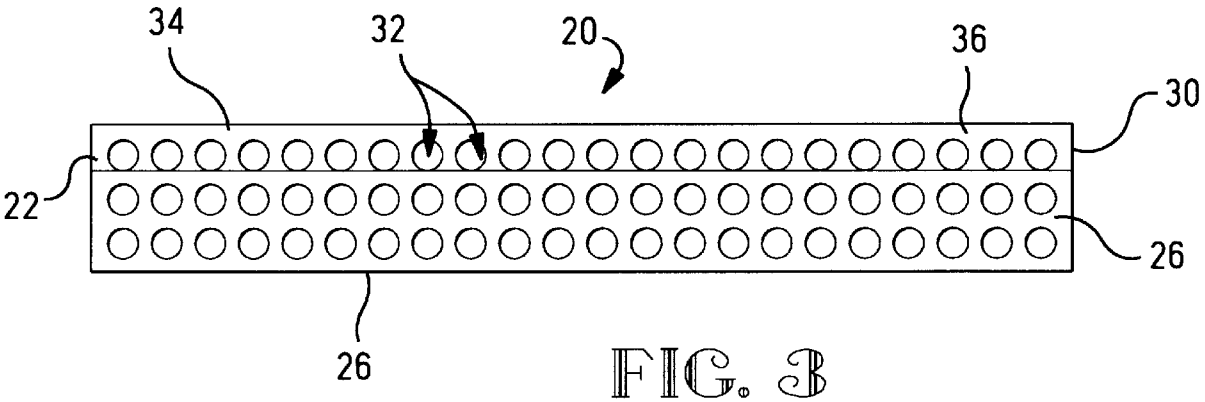
FIG. 3 is a top plan view of the coupling device shown in FIGS. 1 and 2.

Coupling device 20 is a dielectric member having a top wall 22, a bottom wall 24, a front wall 26, rear wall 28, and opposed end walls 30. Coupling device 20 includes a plurality of apertures 32 arranged in rows in columns and at the same spacing as the array of terminals in the connector to which it will be attached as best seen in FIG. 3. The array of apertures 32 has a first end portion 34 adapted to grip exposed terminal body portions 68 in a first group of terminals disposed in first end portion 53 of first electrical connector 40 and a second end portion 36 of apertures adapted to grip exposed terminal body portions 98 in a second group of terminals disposed in second end portion 83 of second connector 70. In the embodiment shown connectors 40 and 70 are of identical lengths. In some connector configurations, portions of the housings may need to be removed between adjacent terminals such as illustrated in FIGS. 1 and 2. It is to be understood that different lengths of connectors may be joined and, in fact, additional modules also may be joined with use of additional coupling devices 20.

Figure 5:
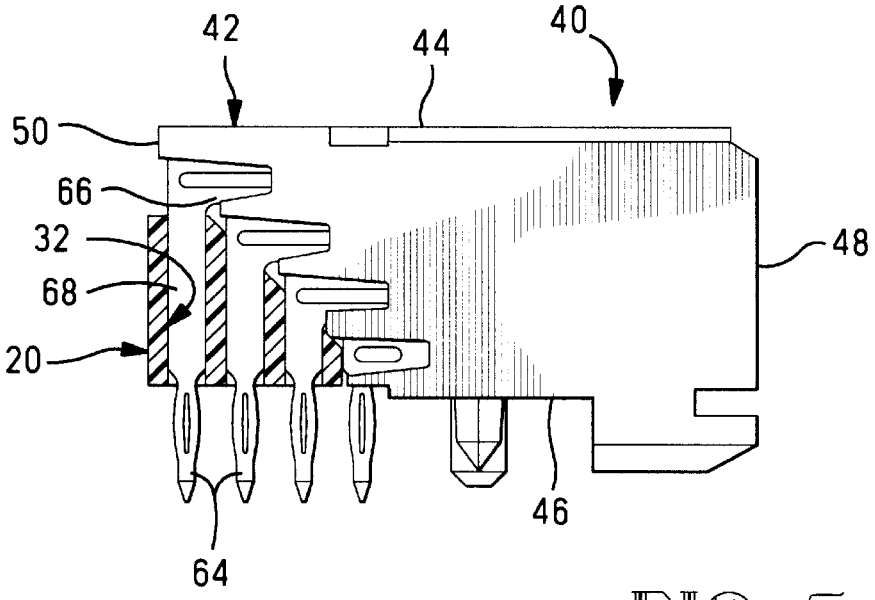
FIG. 5 is an assembled view of the connector and device of FIG. 4.

The connector assembly 110, as shown in FIGS. 2 and 6, is formed by placing the first and second connectors 40, 70 adjacent to each other such that the corresponding endwalls 52, 82 along respective first and second end portions 53, 83 abut one another. The coupling device 20 is positioned such that a plurality of the second contact portions 64 of first terminals 60 are aligned with corresponding apertures 32 of the first device end portion 34 and the second terminal contact potions 94 of second terminals 90 are aligned with the apertures 32 of second device end portion 36. The coupling device 20 is then moved toward the top wall 44, 74 of the first and second connector housings 40, 70 until the apertures 32 grip the respective exposed body portion 68, 98 in an interference fit. The coupling device 20 is dimensioned so that upon full assembly the second contact sections 64, 94 extend below the coupling device 20 as best seen in FIGS. 2, 5 and 6. As can be appreciated from FIG. 5, the second contact portions 64 of terminals 60 in housing 40 must be smaller than the aperture 32 such that the coupling device 20 will slide upwardly into position without damaging any plating on the contact surface 64. The embodiment 20 of the coupling device is designed for use with those connectors having contact sections that are smaller than the intermediate body portions so that the apertures 32 can grip the respective body portions in an interference fit. Upon full insertion of the coupling device 20, the connector assembly 110 may be handled as a unit to be mounted to a back plane or circuit board.

Figure 7:
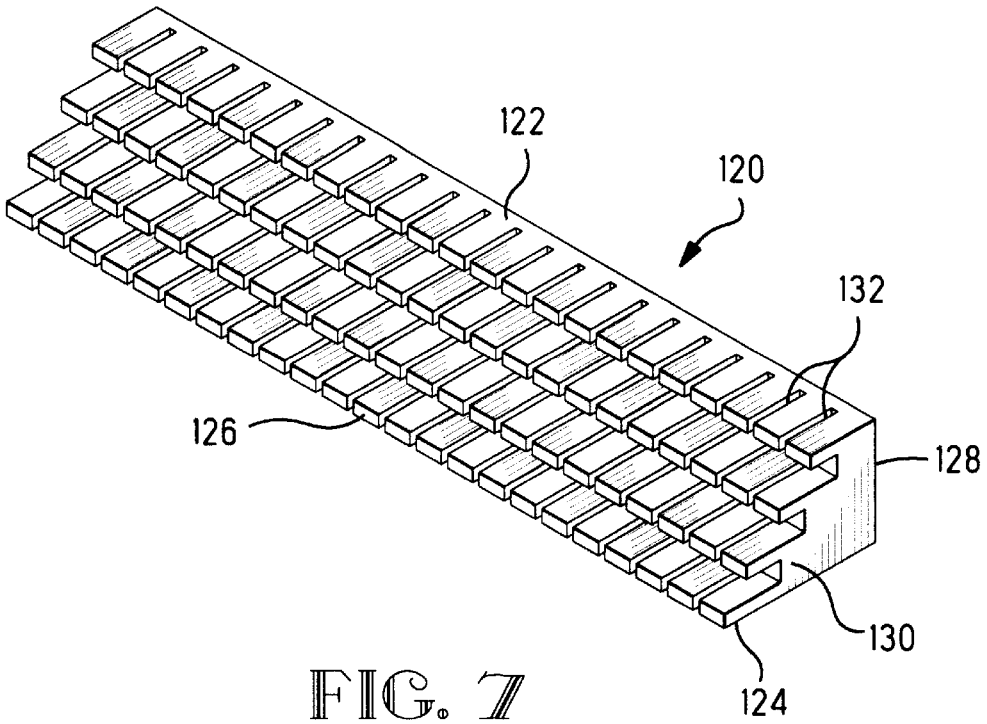
FIG. 7 is an isometric view of an alternative embodiment of the coupling device.
Figure 8:
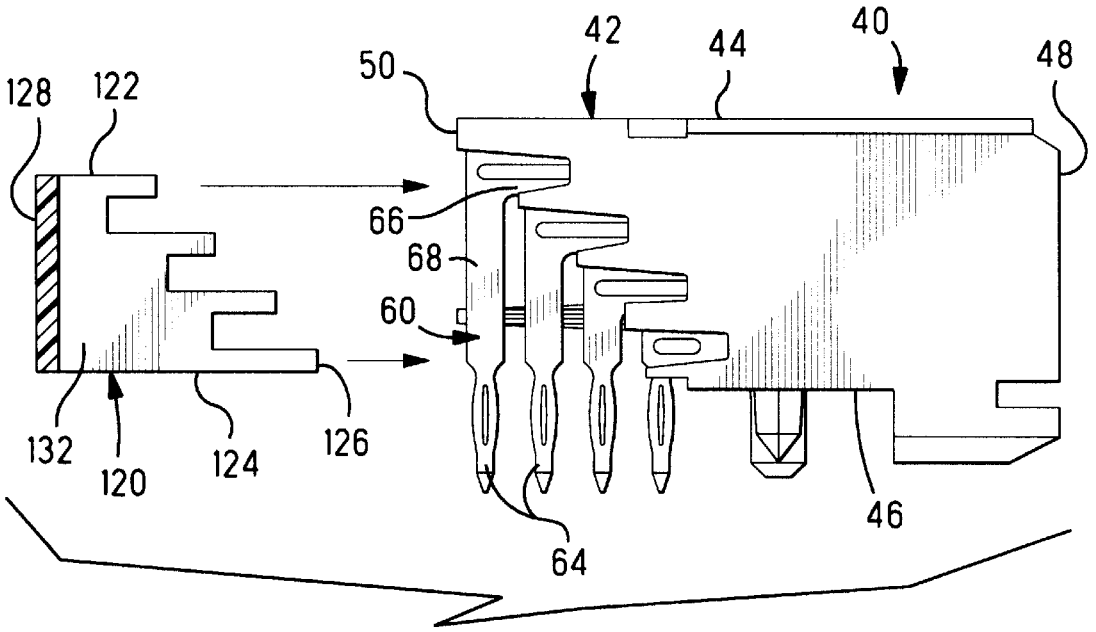
FIG. 8 is a cross-sectional view of a connector using the coupling device of FIG. 7.
Figure 9:
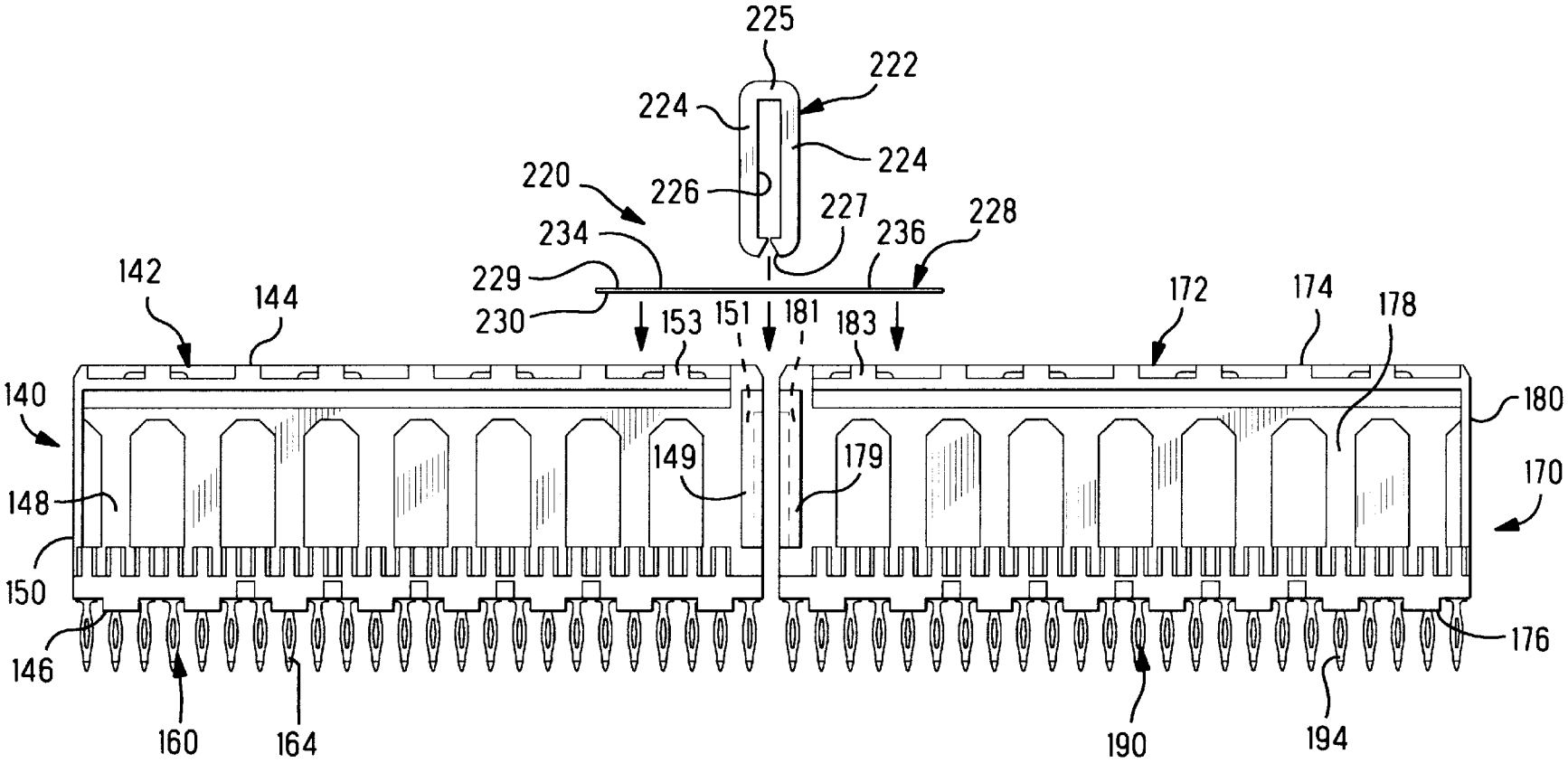
FIG. 9 is a side view of an alternative embodiment of the connector assembly of the present invention with the connectors and an alternate embodiment of the coupling device exploded from one another.
Figure 10:
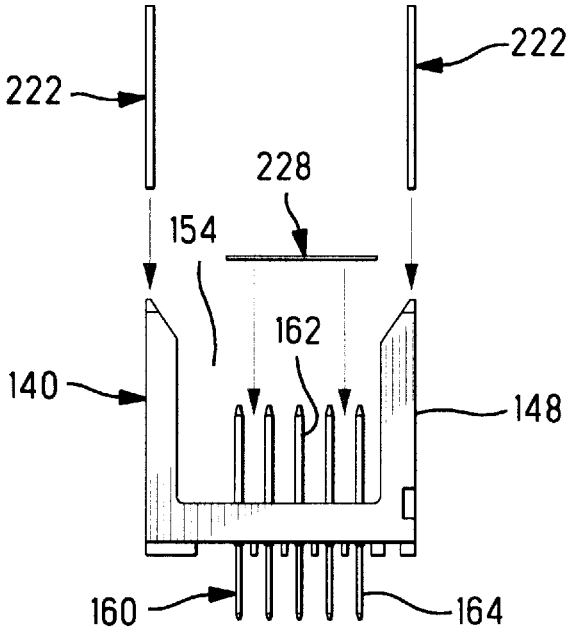
FIG. 10 is an end view of one of the connectors of FIG. 9 with the coupling device in alignment for positioning on the terminals and housing.

FIGS. 7 and 8 illustrate a further embodiment 120 of the coupling device in which the openings are a plurality of slots 132 configured to be inserted between adjacent terminals such that the slots 132 will grip the intermediate body portion in an interference fit. The embodiment 120 includes a top wall 122, a bottom wall 124, a front face 126, a rear face 128, and a plurality of slots 132. In the embodiment shown there are four rows of slots. Depending on the configuration of the housing and the size of the contact section with respect to the body section of the terminals, embodiment 120 may be more appropriate since it is inserted into the back of the housing and slides directly onto the exposed body portions.

Another embodiment of connectors 140, 170 and accompanying coupling device 220 is illustrated in FIGS. 9 through 12. First and second connectors 140, 170 include respective first and second end portions 153, 183 to be adjacent each other when the connectors are coupled. First connector 140 includes a housing 142 having a mating face 144, a mounting face 146, sidewalls 148, ends 150, and floor 152, which together define a mating cavity 154 dimensioned to receive a complementary plug connector (not shown). Housing sidewalls 148 include a latching tab 149 extending outwardly from the outer surface thereof proximate at least one of said ends. Each tab 149 defines a latching channel 151 dimensioned to cooperate with the coupling device 220, as explained below. Housing 142 further includes a plurality of first terminals 160 disposed therein. Each first terminal 160 includes a first contact portion 162 exposed in the mating cavity 154 for mating with a complimentary connector (not shown), a second contact portion 164 extending outwardly from the housing 142 at the mounting face 146 thereof, and an intermediate body section (not shown) extending therebetween and secured in said floor 152.

The second connector 170 is similar to first connector 140 and includes a housing 172 having a mating face 174, a mounting face 176, sidewalls 178, ends 180, and floor 182, which together define a mating cavity 184 dimensioned to receive a complementary plug connector (not shown). Housing sidewalls 178 include a latching tab 179 extending outwardly from the outer surface thereof proximate at least one of said ends. Each tab 179 defines a latching channel 181 dimensioned to cooperate with the coupling device 220, as explained below. Housing 172 further includes a plurality of first terminals 190 disposed therein. Each first terminal 190 includes a first contact portion 192 exposed in the mating cavity 184 for mating with a complimentary connector (not shown), a second contact portion 194 extending outwardly from the housing 172 at the mounting face 176 thereof, and an intermediate body section (not shown) extending therebetween and secured in said floor 182.

Coupling device 220 is a two part device, the first being a clip 222 for interlocking adjacent housing walls together on the outside surfaces thereof, and the second being a plate-like dielectric member 228. Clip 222 is U-shaped and includes two resilient legs 224 joined together at one end by a strap 225 and free ends defining inwardly directed projections defining rearwardly facing latch surfaces 227 that almost converge at the other end thereof, altogether defining a slot 226 dimensioned to be received in respective channels 151,181 defined by the tabs 149, 179, on the respective housings sidewalls 148, 178. Dielectric member 228 includes opposed upper and lower surfaces 229, 230 and a plurality of apertures 232 extending therethrough. Apertures 232 are arranged in rows and columns at the same spacing as the respective arrays of terminals in the connectors that are to be coupled. The array of apertures 232 have a first end portion 234 adapted to be received by a first plurality of terminals 160 in first connector 140 and a second end portion 236 adapted to be received by a second plurality of terminals 190 in second connector 170. In the embodiment shown connectors 140 and 170 are of identical lengths. It is to be understood that different lengths of connectors maybe joined and, in fact, additional modules also may be joined with use of additional coupling devices 220.

Figure 11:
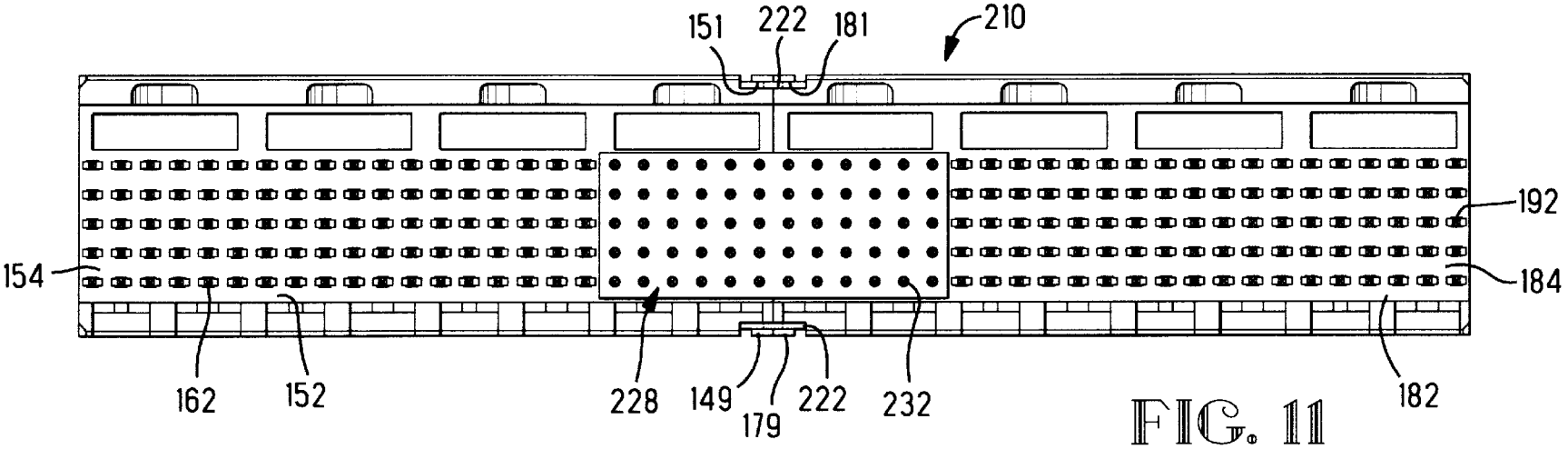
FIG. 11 is a top plan view of the assembled coupled connector assembly shown in FIG. 9.
Figure 12:
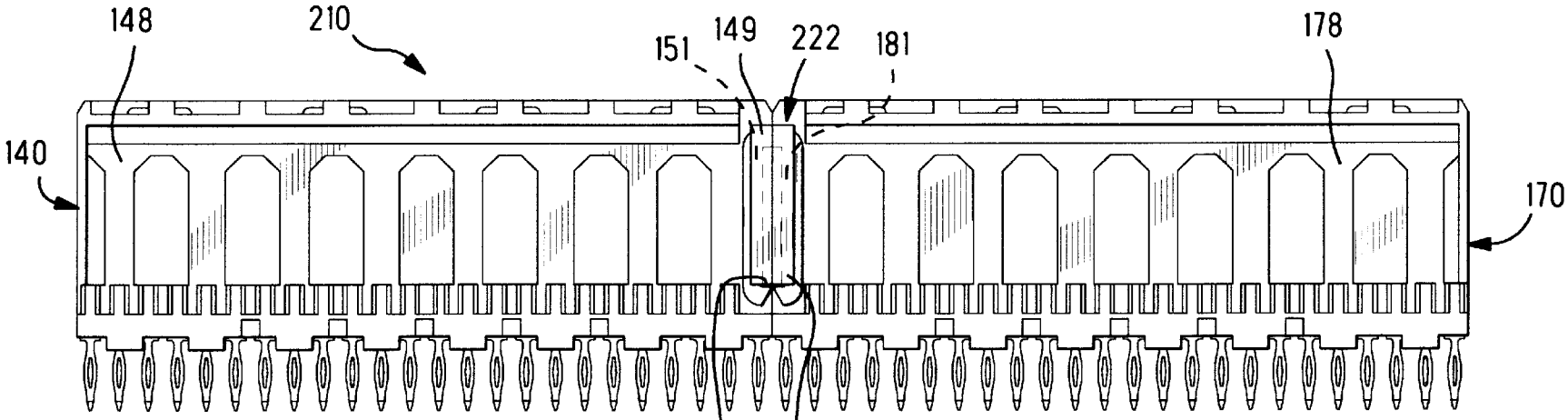
FIG. 12 is a side view of the assembled coupled connector assembly shown in FIG. 9.

The connector assembly 210, as shown in FIGS. 11 and 12, is formed by placing the first and second connectors 140, 170 adjacent to each other such that the corresponding ends 150, 180 abut one another. The dielectric member 228 of coupling device 220 is positioned such that a plurality of the first contact portions 162 of first terminals 160 are aligned with corresponding apertures 232 of the first portion 234 and the first terminal contact potions 192 of second terminals 190 are aligned with the corresponding apertures 232 of second portion 236. Dielectric member 228 is then moved down into the mating cavities 154, 184 until it engages the respective floors 152, 182. A clip 222 is assembled on both sides of the connectors 140, 170 with one leg 224 being inserted into the respective sidewall channels 151, 181 with slot 226 receiving portions of tabs 149, 179. The clips 222 are moved toward the mounting faces 146, 176 of connectors 140, 170 until the latching projections seat beneath tabs 149,179 for latch surfaces 227 to face the lower surfaces of tabs 149,179, thereby holding the sidewalls 148, 178 of the connectors 140,170 together, as shown in FIG. 12. Clip 222 may be made from metal or dielectric material.

Figure 13:
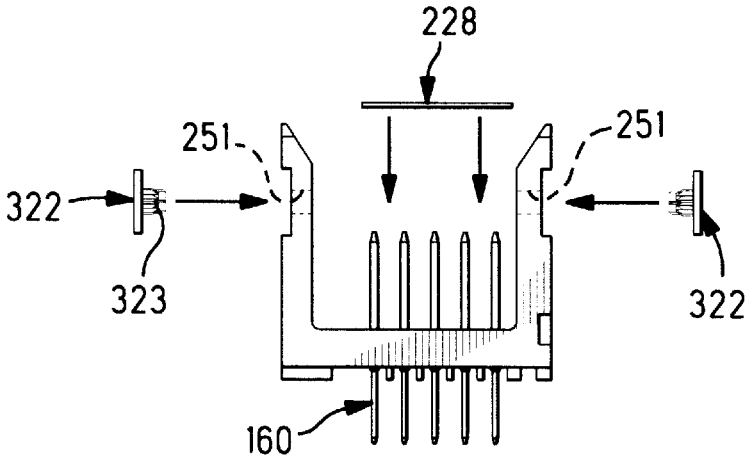
FIG. 13 is an end view of a further embodiment of the connector and coupling device made in accordance with the present invention with the coupling device in alignment for positioning on the terminals and housing.
Figure 14:
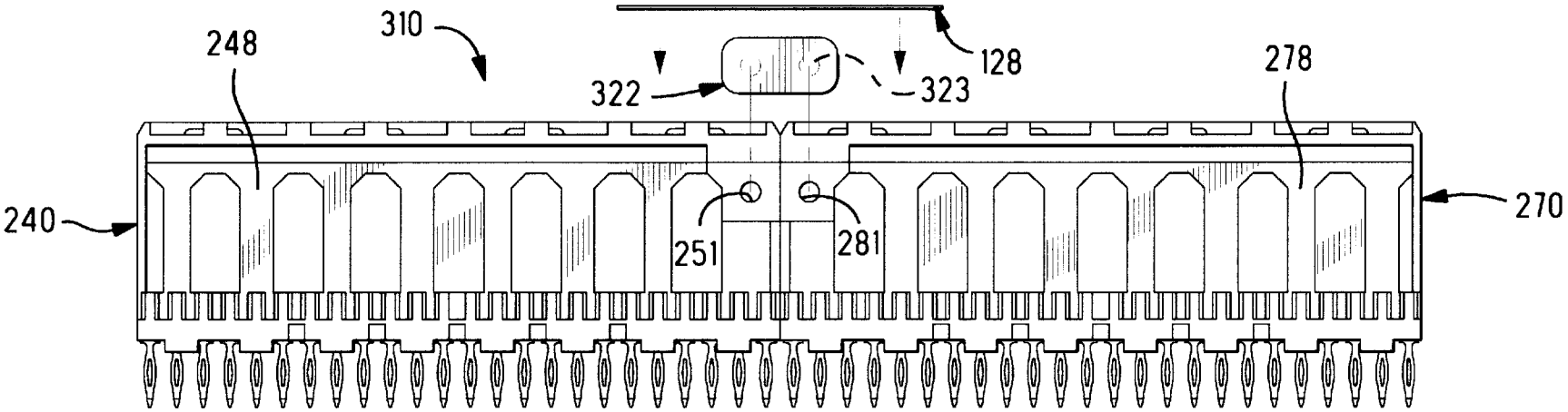
FIG. 14 is a side view of the assembled coupled connector assembly shown in FIG. 13.

In the further alternative embodiment 310 of connector assembly, as shown in FIGS. 13 and 14, clip 322 is a plate-like member having at least two projections 323 extending outwardly from one side thereof and adapted to be received in an interference fit in cooperating holes 251, 281 extending into housing sidewalls 248, 278 of connectors 240, 270 proximate the ends thereof. Dielectric member 228 is assembled to the adjacent connectors of this embodiment in the manner previously described.

Figure 15:
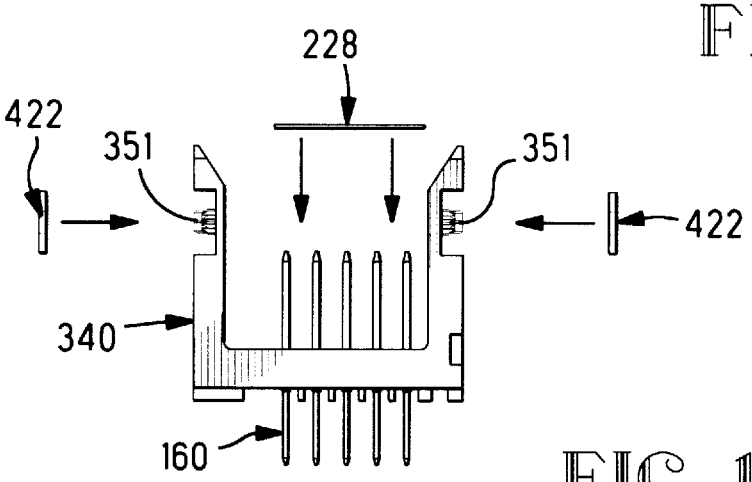
FIG. 15 is an end view of another embodiment of the connector and coupling device made in accordance with the present invention with the coupling device in alignment for positioning on the terminals and housing.
Figure 16:
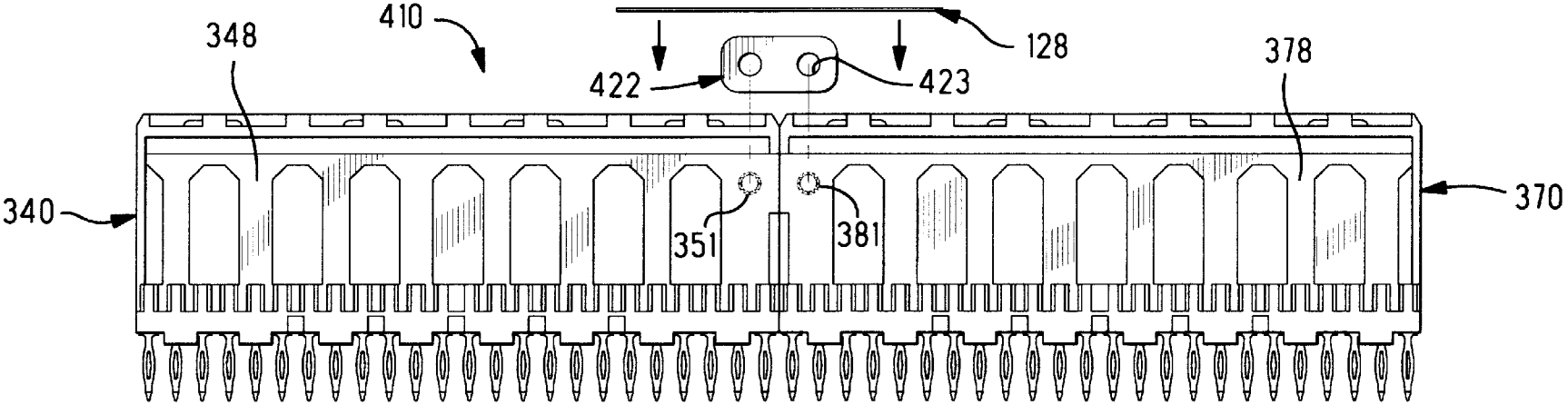
FIG. 16 is a side view of the assembled coupled connector assembly shown in FIG. 15.

In the still further alternative embodiment 410 of connector assembly, as shown in FIGS. 15 and 16, housing sidewalls 348, 378 include respective projections 351, 381 extending outwardly therefrom proximate at least one end thereof. In this embodiment, clip 422 is a plate-like member having at least two apertures 423 extending therethrough and adapted to receive respective projections 351, 381 therein in an interference fit, thereby securing the housings together. Dielectric member 228 is assembled to the connectors of this embodiment in the manner previously described.

It is thought that the coupling devices of the present invention and many of their attendant advantages will be understood from the foregoing description. It is apparent that various changes may be made in the form, construction, and arrangement of parts thereof without departing from the spirit or scope of the invention, or sacrificing all of its material advantages.

We claim:

1. A device for coupling first and second electrical connectors laterally end-to-end, said first and second connectors including first and second end portions to be adjacent each other when coupled, each connector including a housing having a plurality of terminals secured therein, each of said terminals including a body section, said housing of each of said connectors exposing a portion of said body section of said terminals thereof, said first and second connectors having respective first and second selected groups of terminals disposed in said respective first and second end portions of said first and second connectors, each said selected first and second group including less than all terminals in the respective connector; said device comprising:

a dielectric member having first and second end portions adjacent each other and complementary to the respective first and second end portions of said first and second connectors, said member end portions including a respective first and second group of openings extending therethrough and associated with said first and second terminal groups, each said opening adapted to grip a body portion of only a single respective said terminal;

whereby upon placing said first and second connectors with said first and second end portions adjacent each other end to end, and positioning said dielectric member to coextend along said first and second end portions with respective first and second groups of openings and urging said openings along said terminal body sections toward said first and second connectors in gripping relationship with respective said body portions of said selected first and second terminals groups, said member mechanically secures together said first and second connectors laterally adjacent each other.

2. The device for coupling first and second electrical connectors of claim 1 wherein said dielectric member is a further housing having said openings therein dimensioned to receive respective exposed body sections of said terminals of each selected group in each of said first and second connectors such that respective board contact sections extend below outwardly of respective ones of said openings and are aligned for mounting in through-holes of a circuit board.

3. The device for coupling first and second electrical connectors of claim 2 wherein said openings are apertures extending between opposed top and bottom faces of said further housing.

4. The device for coupling first and second electrical connectors of claim 2 wherein said openings are slots extending into and through said further housing from a forward face to a rearward face thereof.

5. The device for coupling first and second electrical connectors of claim 2 wherein said openings of said further housing are in an array having several rows and several columns complementary to the rows and columns of said terminals of said first and second connectors.

6. The device for coupling first and second electrical connectors of claim 1 wherein said dielectric member is a plate-like member and said device further includes at least one clip for interlocking together adjacent housing walls of the respective connectors.

7. The device for coupling first and second electrical connectors of claim 6 wherein said openings of said plate-like member are in an array having several rows and several columns complementary to rows and columns of said terminals of said first and second connectors.

8. The device for coupling first and second electrical connectors of claim 7 wherein each housing includes an outwardly extending latching tab proximate at least one end thereof, each tab defining a latching channel dimensioned to cooperate with one of said at least one clip, and wherein each said clip comprises a pair of stiff spring arms coextending from a strap to free ends deflectable thereapart during insertion along said latching channels, and said free ends include latching projections protruding from facing surfaces of respective said spring arms to seat in corresponding ones of said channels to latch said clip to said first and second connectors.

9. The device for coupling first and second electrical connectors of claim 8 including two said clips, each associated with a respective aligned pair of side walls of the first and second housings.

10. The device for coupling first and second electrical connectors of claim 6 wherein each said clip includes a pair of projections co-extending from a transverse body to be received in an interference fit in respective apertures of housings of said first and second connectors.

11. The device for coupling first and second electrical connectors of claim 6 wherein each said clip defines apertures therethrough for receipt therethrough of projections of the housings of the first and second connectors in an interference fit.

12. The device for coupling first and second electrical connectors of claim 11 wherein said projections extend outwardly from said housings and define recessed along side surfaces thereof.

13. A connector assembly comprising:

at least first and second adjacent end-to-end discrete electrical connectors, said first and second connectors including first and second end portions to be adjacent each other when coupled together, each connector including a housing having a plurality of terminals secured therein, each of said terminals including a body section, said housing of each of said connectors exposing a portion of said body section of said terminals thereof;

said first and second connectors having respective first and second selected groups of terminals disposed in said respective first and second end portions of said first and second connectors, each said selected first and second group including less than all terminals in the respective connector; and a coupling device securing together said at least first and second connectors adjacent each other, said device including a dielectric member having first and second end portions adjacent each other and complementary to respective first and second end portions of said first and second connectors, said member end portions including a respective first and second group of openings extending therethrough and associated with first and second terminal groups, each opening of said first and second groups of openings gripping only a single respective said body portion of said selected first and second terminal groups of said first and second connectors.

14. The connector assembly of claim 13 wherein said coupling device is a further housing having said openings therein dimensioned to receive respective exposed body sections of said terminals of each selected group in each of said first and second connectors such that respective board contact sections extend below outwardly of respective ones of said openings and are aligned for mounting in through-holes of a circuit board.

15. The connector assembly of claim 14 wherein said openings are apertures extending between opposed top and bottom faces of said further housing.

16. The connector assembly of claim 14 wherein said openings are slots extending into and through said further housing from a forward face to a rearward face thereof.

17. The connector assembly of claim 13 wherein said coupling device includes first and second parts, the first part being a plate-like dielectric member and the second part being at least one clip for interlocking together adjacent housing walls of the respective connectors.

18. The connector assembly of claim 17 wherein each housing includes an outwardly extending latching tab proximate at least one end thereof, each tab defining a latching channel dimensioned to cooperate with one of said at least one clip, and wherein each said clip comprises a pair of stiff spring arms coextending from a strap to free ends deflectable thereapart during insertion along said latching channels, and said free ends include latching projections protruding from facing surfaces of respective said spring arms to seat in corresponding ones of said channels to latch said clip to said first and second connectors.

19. The connector assembly of claim 13 wherein each said clip includes a pair of projections co-extending from a transverse body to be received in an interference fit in respective apertures of housings of said first and second connectors.

20. The connector assembly of claim 13 wherein each said clip defines apertures therethrough for receipt therethrough of projections of the housings of the first and second connectors in an interference fit.

* * * * *